US008508319B1

(12) United States Patent
Newsham et al.

(10) Patent No.: US 8,508,319 B1
(45) Date of Patent: Aug. 13, 2013

(54) RAPIDLY TUNABLE RF CAVITY

(75) Inventors: David Newsham, San Diego, CA (US); Nikolai Barov, San Diego, CA (US)

(73) Assignee: Far-Tech, Inc., San Diego, CA (US)

( * ) Notice: Subject to any disclaimer, the term of this patent is extended or adjusted under 35 U.S.C. 154(b) by 727 days.

(21) Appl. No.: 12/617,692

(22) Filed: Nov. 12, 2009

Related U.S. Application Data

(60) Provisional application No. 61/114,123, filed on Nov. 13, 2008, provisional application No. 61/121,062, filed on Dec. 9, 2008.

(51) Int. Cl.
*H01P 7/08* (2006.01)

(52) U.S. Cl.
USPC ..... 333/231

(58) Field of Classification Search
USPC ..... 333/227, 231, 202, 208, 209, 245
See application file for complete search history.

(56) References Cited

U.S. PATENT DOCUMENTS 3,735,286 A * 5/1973 Vane ..... 331/101
6,211,463 B1 * 4/2001 Fabis ..... 174/548
6,801,104 B2 * 10/2004 Zhu et al. ..... 333/202

* cited by examiner

*Primary Examiner* — Benny Lee
*Assistant Examiner* — Gerald Stevens
(74) *Attorney, Agent, or Firm* — Ezliabeth Kim Patent Law Offices LLC

(57) ABSTRACT

A rapidly tunable RF cavity includes a cavity body, and at least one ferroelectric element disposed within a hollow interior region of the cavity body. A biasing system provides a nominal DC electric field bias across the ferroelectric element so as to induce a rapid change in dielectric permittivity of the ferroelectric element, and a corresponding change in resonant frequency of the RF cavity. A change in dielectric permittivity of up to about 20% can be induced within a response time of less than 10 nanoseconds, with a biasing field strength of less than 50 kV. In some embodiments, the ferroelectric element is made of BST (barium-strontium titanate). The ferroelectric element may be cylindrically shaped, and coaxial with the cavity body. The biasing system may include one or more copper cylinders supported by supporting rods.

21 Claims, 6 Drawing Sheets

Table 1

Modeling Results for Tunable Cavity Design With beta = 0.4

| Dielectric constant | 550 | 600 | 650 |
|---|---|---|---|
| Resonant frequency, MHz | 391.7 | 375.3 | 360.8 |
| Cavity Q | 1433 | 1423 | 1413 |
| Cavity r/Q, Ohm | 22.6 | 22.0 | 21.4 |
| On crest energy gain, keV | 30 | 30 | 30 |
| Cavity wall losses, kW | 8.0 | 8.4 | 8.8 |
| Ferroelectric losses, kW | 19.6 | 20.2 | 20.8 |
| Stem losses, kW | 0.2 | 0.2 | 0.2 |
| Total losses, kW | 27.8 | 28.8 | 29.8 |

FIG. 2

RAPIDLY TUNABLE RF CAVITY

CROSS-REFERENCE TO RELATED APPLICATIONS

This application is based upon, and claims the benefit of priority under 35 U.S.C. §119(e) from U.S. Provisional Patent Application Ser. No. 61/114,123 (the "'123 provisional application"), filed Nov. 13, 2008, entitled "Rapidly Tunable RF Cavity," and from U.S. Provisional Patent Application Ser. No. 61/121,062 (the "'062 provisional application"), filed Dec. 9, 2008, entitled "Rapidly Tunable RF Cavity." The contents of the '123 provisional application and the '062 provisional application are incorporated herein by reference in their entireties as though fully set forth.

BACKGROUND

The FFAG (fixed-field alternate gradient) accelerator offers an attractive solution for systems that require rapid acceleration of charged particles over a wide range of energies. It performs rapid acceleration at significant reduced size of both the magnetic components and the overall accelerating structure without the need to alter the current in the electromagnet.

These advantages of the FFAG accelerator require rapidly tunable RF (radio frequency) cavities. In particular, rapidly tunable RF cavities are needed to accelerate charged particles as they gain momentum each time they orbit in the FFAG accelerator.

Rapid frequency tuning in RF cavities remains a significant challenge, however, for the above-described FFAG accelerator, as well as for other applications.

BRIEF DESCRIPTION OF THE DRAWINGS

The drawings disclose illustrative embodiments. They do not set forth all embodiments. Other embodiments may be used in addition or instead. When the same numeral appears in different drawings, it refers to the same or like components or steps.

FIG. 2 is a table that illustrates simulated RF properties for a rapidly tunable RF cavity in accordance with one embodiment of the present disclosure.

DETAILED DESCRIPTION

The present disclosure describes methods and systems relating to rapidly tunable RF cavities. In overview, the use of ferroelectric material (which changes permittivity with applied electric field) is disclosed. By applying a nominal DC electric field bias over one or more ferroelectric elements within an RF cavity, fast frequency tuning is achieved for RF cavities.

Illustrative embodiments are now discussed. Other embodiments may be used in addition or instead.

Figure 1A:
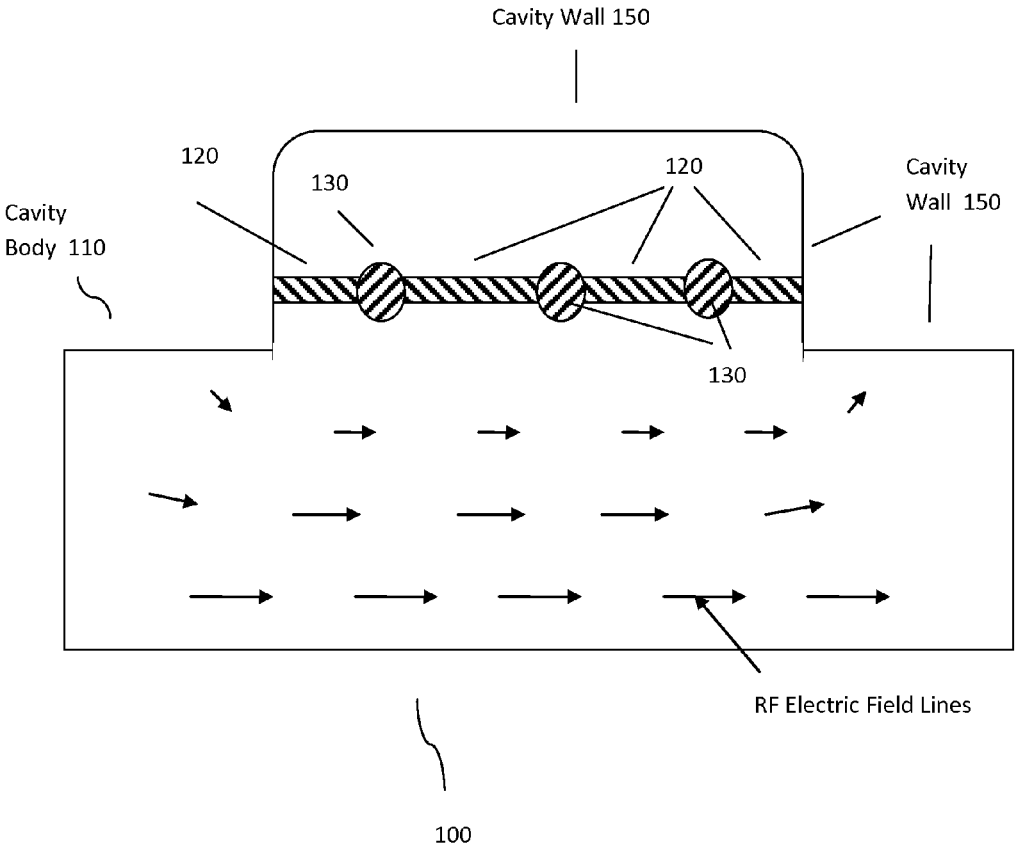
FIG. 1A illustrates a schematic block diagram of a rapidly tunable RF cavity, in one embodiment of the present disclosure.
Figure 1B:
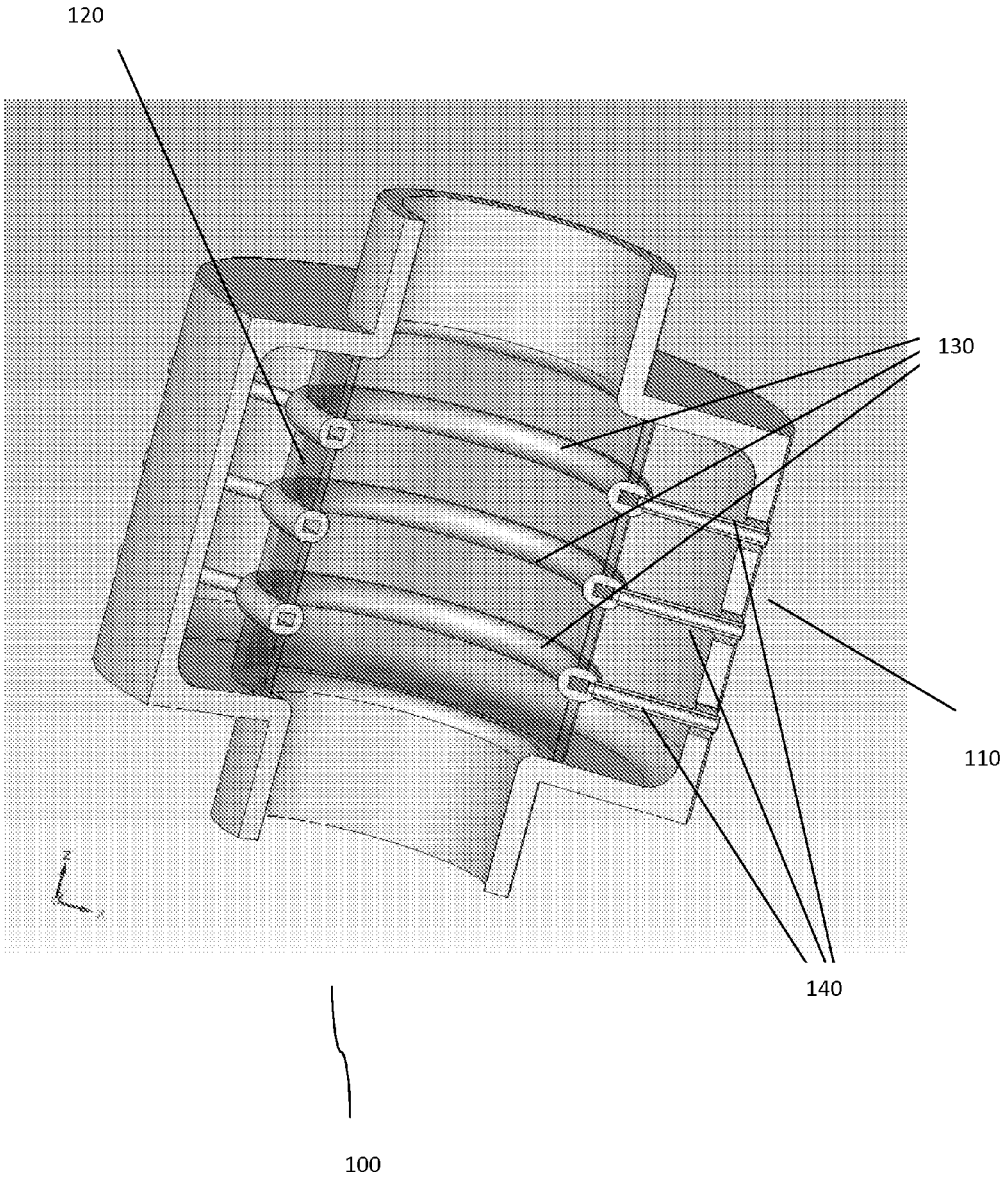
FIG. 1B illustrates a cut-away view of the RF cavity illustrated in FIG. 1A.

FIG. 1A illustrates a schematic block diagram of a rapidly tunable RF cavity 100, in one embodiment of the present disclosure. FIG. 1B illustrates a cut-away view of the RF cavity illustrated in FIG. 1A.

In overview, the RF cavity 100 includes a cavity body 110, a plurality of elements 120 that are made of a ferroelectric material; and a biasing system configured to provide a nominal DC electric field bias to the ferroelectric elements. The biasing system includes copper tubes or cylinders 130, thin supporting rods 140 (shown in FIG. 1B) that structurally support the copper cylinders 130, and a source (not shown) of the nominal DC electric field. In the present disclosure, "nominal DC electric field" means an electric field that changes slowly relative to the RF frequency of the cavity. Field lines 180 of the nominal DC electric field are shown in FIG. 1A.

In the illustrated embodiment, the cavity body 110 has a pillbox shape, and the ferroelectric elements 120 have a cylindrical shape. Other embodiments may have a cavity body with a different shape and configuration, and may have ferroelectric elements having different shapes and configurations.

The ferroelectric cylinders 120 are disposed within an interior region defined by the cavity body 110. As illustrated in both FIG. 1A and FIG. 1B, the ferroelectric cylinders 120 are separated by the copper cylinders 130, and span the space between the walls 150 of the pillbox cavity body 110. In the illustrated embodiment, the central copper cylinder is held at ground potential, the same as the outer wall of the cavity, while the two outside copper cylinders are held at a higher or lower voltage to provide the biasing electric field. The central copper cylinder thus does not need to be electrically isolated from the outer wall, and does not need a choke joint.

In the embodiment illustrated in FIGS. 1A and 1B, the RF cavity 100 has a length of about 5.5 cm, a cavity radius of about 4.5 cm, and a tuning frequency range of about 30 MHz (361-391 MHz). Other embodiments may have different dimensions and different tuning ranges for the RF cavity.

The copper cylinders 130 are structurally supported by the thin supporting rods in a manner similar to a drift tube linac (DTL), although unlike a DTL, the spacing between the cylinders is much less than beta times $\lambda$, where beta is the particle velocity divided by the speed of light and $\lambda$ is the wavelength corresponding to the RF frequency. The copper cylinders 130 together with their supporting rods 140 provide a nominal DC electric field along the longitudinal direction of the ferroelectric elements 120.

In some embodiments, the ferroelectric cylinders 120 have a longitudinal length that is less than about 1 cm. In this way, the voltage needed to provide the biasing electric field can be kept below about 50 kV, while providing a maximal range of tuning.

In the illustrated embodiment, the ferroelectric material of the cylinders 120 is a BST (barium-strontium titanate) compound. While BST can be made with a wide range of dielectric constants, down to about 150, the nominal dielectric constant of BST is about 550 to about 650. The BST ferroelectric has a low loss tangent at 700 MHz (~5×10-4) and fast rise time (<10 ns). Other properties of the BST ferroelectric include a breakdown limit of 200 kV/cm, and thermal conductivity of 7.02 W/m-K. In some embodiments, the dielectric permittivity of BST can be increased by as much as about 20% with a bias electric field of about 45 kV/cm.

In some embodiments, the RF cavity 100 may have an operating frequency of about 375 MHz, and a tunable frequency range between about 361 MHz and about 391 MHz. FIG. 2 is a table that illustrates simulation results for three values of the dielectric constants of the ferroelectric material: 550, 600, and 650. In FIG. 2, the power losses were calculated for an average on-crest energy gain of 30 keV per cavity for beta=0.4. For the same energy gain per cavity, the disclosed embodiments offer, without optimization, a significantly decreased power consumption and a significantly increased tunable range.

In some embodiments, DC voltage biasing may be achieved by running the support rods out a hole in the radial wall of the cavity. In these embodiments, the coaxial region between the cavity wall and the support rod is extended by attaching a radial cylinder on the outside of the cavity creating a coaxial line. Without mitigation, the bulk RF field from the cavity will be transferred out of this coaxial line, and this RF field can be cut off using an industry standard choke joint method in the coaxial line.

Figure 3:
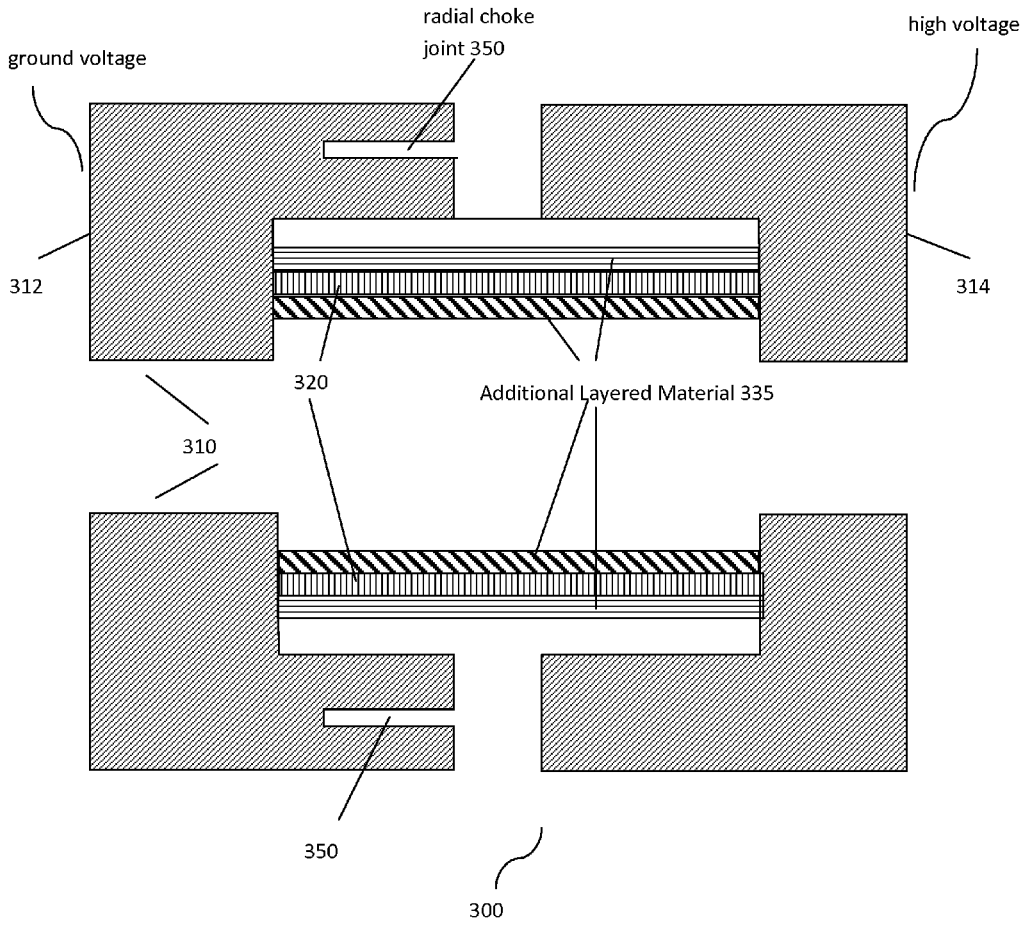
FIG. 3 illustrates a rapidly tunable RF cavity having a single ferroelectric cylinder coaxially aligned with the cavity body, in accordance with another embodiment of the present disclosure.

FIG. 3 illustrates a rapidly tunable RF cavity 300 having a single ferroelectric cylinder 320 coaxially aligned with a cavity body 310, in accordance with another embodiment of the present disclosure. In the embodiment illustrated in FIG. 3, the outer wall of the cavity body 310 is split, because the RF cavity 300 must be biased, and a radial choke joint 350 is provided to prevent the RF power from leaking out the walls. In order to provide the nominal DC bias across the ferroelectric cylinder 320, one side (shown as 312) of the cavity body 310 is held at ground potential, and the other side (314) is held at a higher, or lower, voltage.

In some embodiments, one or more layers 335 of additional material may be placed on the outside and/or inside surface of the ferroelectric material forming the ferroelectric cylinder 320, by analogy to a cylindrical sandwich. These layer(s) 335 of additional material(s) could provide increased strength and increased thermal conductivity over those of the ferroelectric material of which the cylinder 320 is made, to better transport heat to the cavity walls.

One example of an additional material for increased thermal conductivity is CVD (chemical vapor deposition) diamond. Other embodiments of the present disclosure may use a material other than CVD diamond for the added layers 335 of additional material.

Figure 4:
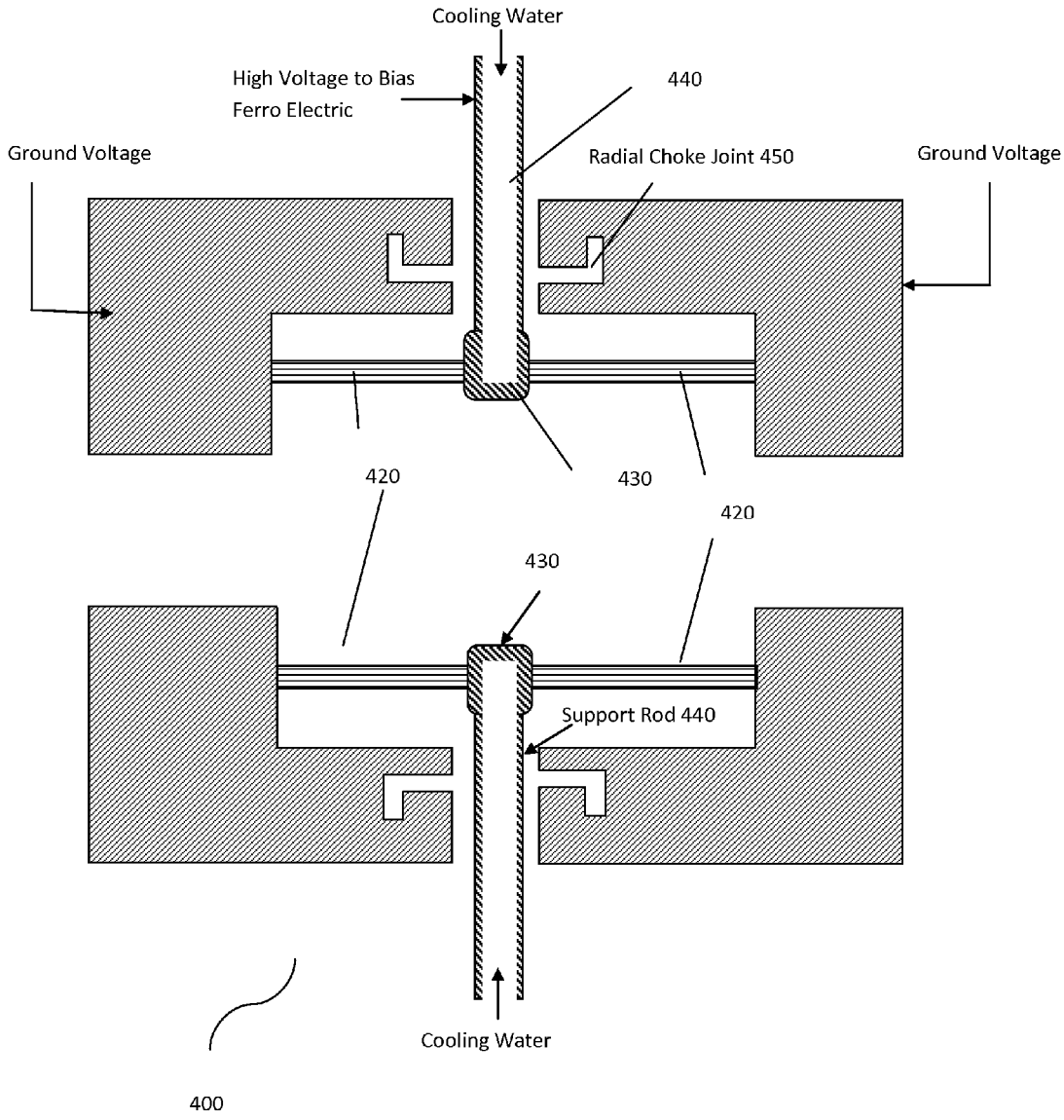
FIG. 4 illustrates a rapidly tunable RF cavity with two ferroelectric cylinders and a single copper rod for providing an electric field bias, in accordance with another embodiment of the present disclosure.

In some embodiments, the support rods or stems that support the copper cylinders (which provide the electric field bias) may also be used to provide water cooling to the copper cylinders, as illustrated in FIG. 4. FIG. 4 illustrates a rapidly tunable RF cavity 400 with two ferroelectric elements 420 and a single copper tube 430 for providing an electric field bias, in accordance with another embodiment of the present disclosure. The ferroelectric elements 420 and the copper tube 430 have ring-shaped or annular configurations.

The copper ring 430 allows for the cavity body 410 to be kept at ground while applying the high voltage bias to the copper ring 430. One or more support rods 430 support the copper ring 430.

In the embodiment illustrated in FIG. 4, the same support rods or stems that are used to provide the DC bias can provide cooling fluid to the copper rings. The support stems may be made of hollow tubes, and a channel may be cut in the copper ring. Two tubes are provided, in the embodiment illustrated in FIG. 4. Cooling fluid flows in one tube. It then circulates in both directions halfway around the copper ring, then exits the tube on the opposite side. As seen in FIG. 4, the support rods are disposed in two locations around the aximuth of the copper ring. A radial choke joint 450 prevents the main RF power from leaking out, as explained previously. In FIG. 4, a simple choke joint geometry is shown where the cooling rods exit through the cavity wall.

In other embodiments (not illustrated), RF compatible cooling fluid may enter the annular region between the ferroelectric and the outer cavity wall by appropriately sized holes in the side wall of the cavity at one end (longitudinal). In these embodiments, the fluid flows in the coaxial region down the axis of the cavity and exits via similar holes in the opposite longitudinal wall of the cavity.

While illustrative embodiments have been disclosed in connection with the above figures, any number of ferroelectric elements and/or copper cylinders and/or support rods may be used, in other embodiments of the present disclosure.

In one or more of the exemplary embodiments discussed above, the RF cavity had an operating frequency of about 375 MHz. In general, the nominal frequency of a cavity is determined by four factors: 1) the outer diameter of the pillbox type structure; 2) the thickness of the ferroelectric material; 3) the base dielectric constant of the ferroelectric material; and 4) the nominal radius of the ferroelectric material.

For any pillbox cavity, the outer diameter of the pillbox type structure determines the nominal frequency of the cavity, and is the primary method of setting the operating frequency of all RF cavities. The other three factors are details of the design and the cost of making the ceramic rings. The possible nominal frequency of the cavity is also limited by the frequency range that the ferroelectric material responds in the intended manner. The length of the cavity basically has only a minor effect on the ability to change the operating frequency of the cavity and can be accommodated by adjusting the outer radius of the cavity. Changing the length would require changing the number and length of the ferroelectric cylinders and the copper biasing cylinders to accommodate the longer/shorter design.

In any one of the embodiments disclosed above, main RF power coupling into the RF cavity may be accomplished in a number of ways. In some embodiments, an industry standard iris coupling scheme may be used for the main RF power coupling from a rectangular waveguide, where a coupling hole is made in the wall between the cavity and the rectangular waveguide, despite the small size of the RF cavity disclosed above relative to the size of standard rectangular waveguides at 375 MHz.

In other embodiments, a coaxial power coupler may be used, an example of which is the coaxial power coupler developed by Flöttman at DESY in Germany for the photo injection electron gun for the TESLA XFEL (X-ray Free Electron Laser). Descriptions of such coaxial power couplers are found for example in the following references, all of which are incorporated herein by reference in their entireties:

Flöttmann K., Stephan F., "RF Photoinjectors as Sources for Electron Bunches of Extremely Short Length and Small Emittance", Proposal for the BMBF, 1999. (http://pitz.desy.de/sites/site_pitz/content/e123/e69/e208/infoboxContent210/bmfb__01_englisch_og_eng.pdf);

M. Ferrario, K. Flöttmann, B. Grigoryan, T. Limberg, and P. Piot, "Conceptual Design of the XFEL Photoinjector", TESLA FEL report 2001-03, (2001) (http://flash.desy.de/sites/site_vuvfel/content/e403/e1642/e772/e773/infoboxContent776/fel2001-03-01.pdf);

W. Hartung, et. al. "Studies of Photo-Emission and Field Emission in an RF Photo-Injector with a High Quantum Efficiency Photo-Cathode," Proceedings of the 2001 Particle Accelerator Conference, Chicago p. 2239 (2001);

M. J. de Loos, et. al. "A High-Brightness Pre-Accelerated RF-Photo Injector," Proceedings of EPAC 2002, Paris, France, p. 1831 (2002);

In other embodiments, the above-disclosed choke joints for the support rods may be removed and the coaxial line that is created may be used to input the RF power. A structure outside the cavity would isolate the RF power from the DC biasing.

In other embodiments, standard loop coupling may be used where a wire loop is used to drive the RF field.

In other embodiments, a slot may be put in the side wall of the cavity cell to couple it to an adjacent resonant cavity, which may be of the same type or a different type.

Figure 5:
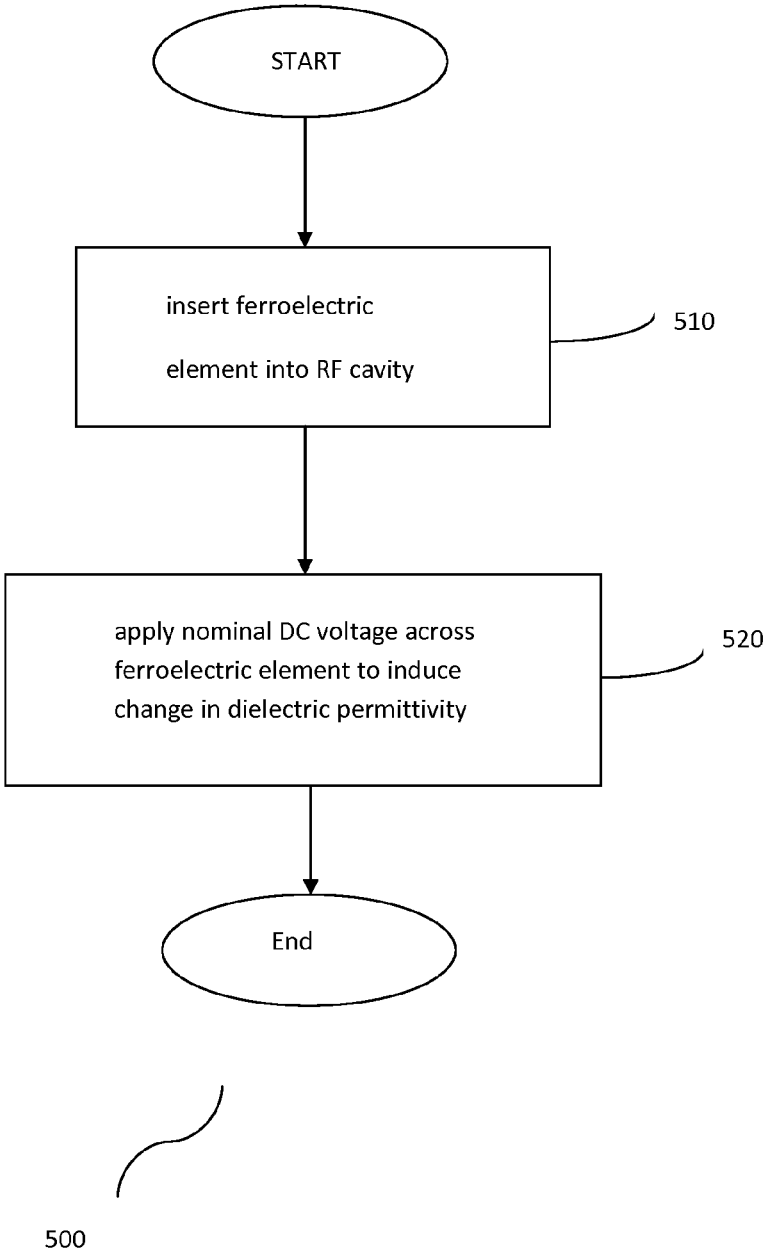
FIG. 5 illustrates a schematic flow chart of a method of rapidly tuning an RF cavity, in accordance with one embodiment of the present disclosure.

FIG. 5 illustrates a schematic flow chart of a method 500 of rapidly tuning an RF cavity, in accordance with one embodiment of the present disclosure. The method 500 includes an act 510 of inserting one or more ferroelectric elements within an interior region of the RF cavity. The method further includes an act 520 of applying a DC electric field bias across the ferroelectric elements so as to induce a change in dielectric permittivity of the ferroelectric element within a time period, and thereby induce a corresponding change in resonant frequency of the RF cavity.

In some embodiments, the method 500 further comprises an act of adding a layer of an additional material on the outer or inner surface of the ferroelectric element, so as to increase the strength and thermal conductivity of the ferroelectric element. In some embodiments, the additional material may be CVD (chemical vapor deposition) diamond.

In some embodiments, the method 500 further comprises the act of providing a radial choke joint in order to prevent RF power from leaking out of the cavity body.

In sum, the present disclosure describes systems and methods for implementing rapidly tunable RF cavities. Many benefits of such rapidly tunable RF cavities are anticipated, in fields that include but are not limited to: nuclear physics (development of electron-light ion colliders and heavy ion accelerators), high energy physics (neutrino factory and muon collider applications), solid state physics and chemistry (muon source for muon spin resonance studies), and production of radioisotopes for PET scanning.

The components, steps, features, objects, benefits and advantages that have been discussed are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages. The components and steps may also be arranged and ordered differently.

Nothing that has been stated or illustrated is intended to cause a dedication of any component, step, feature, object, benefit, advantage, or equivalent to the public. While the specification describes particular embodiments of the present disclosure, those of ordinary skill can devise variations of the present disclosure without departing from the inventive concepts disclosed in the disclosure.

While certain embodiments have been described of systems and methods relating to rapidly tunable RF cavities, it is to be understood that the concepts implicit in these embodiments may be used in other embodiments as well. In the present disclosure, reference to an element in the singular is not intended to mean "one and only one" unless specifically so stated, but rather "one or more." All structural and functional equivalents to the elements of the various embodiments described throughout this disclosure, known or later come to be known to those of ordinary skill in the art, are expressly incorporated herein by reference.

What is claimed is:

1. A tunable RF (radiofrequency) cavity, comprising:

a cavity body defining a hollow interior region;

at least one ferroelectric element disposed within the hollow interior region of the cavity body; and a biasing system configured to apply a DC electric field bias across the at least one ferroelectric element so as to induce a change in dielectric permittivity of the at least one ferroelectric element within a time period, and thereby induce a corresponding change in a resonant frequency of the RF cavity;

wherein the biasing system comprises:

at least one hollow metallic cylinder;

for each hollow metallic cylinder, a supporting rod configured to provide support to the corresponding hollow metallic cylinder; and a source of the DC electric field bias.

2. The tunable RF cavity of claim 1, wherein the time period is less than about ten nanoseconds, and wherein the change in said dielectric permittivity is between about 10% to about 20%.

3. The tunable RF cavity of claim 1, wherein the at least one ferroelectric element comprises a barium-strontium titanate (BST) compound.

4. The tunable RF cavity of claim 1, wherein the at least one ferroelectric element has a substantially cylindrical shape, and a length less than about one cm.

5. The tunable RF cavity of claim 1, wherein the at least one ferroelectric element is coaxially aligned with the cavity body; and wherein the biasing system is configured to apply the DC electric field bias along a longitudinal axis of the at least one ferroelectric element.

6. The tunable RF cavity of claim 1, wherein the at least one hollow metallic cylinder has a substantially annular configuration, and wherein the at least one hollow metallic cylinder comprises copper.

7. The tunable RF cavity of claim 1, wherein the supporting rod comprises at least two supporting rods, and wherein the at least two supporting rods are further configured to provide fluid cooling to the metallic cylinder.

8. The tunable RF cavity of claim 1, wherein the RF cavity has a radius of less than about 4.5 cm, and a length of about 5.5 cm.

9. The tunable RF cavity of claim 1, wherein a strength of the bias-electric field bias is less than about 50 kV/cm.

10. The tunable RF cavity of claim 1, further comprising at least one layer of an additional material disposed on a surface of the at least one ferroelectric element for increased strength and increased thermal conductivity in the at least one ferroelectric element.

11. The tunable RF cavity of claim 10, wherein the additional material comprises CVD (chemical vapor deposition) diamond.

12. The tunable RF cavity of claim 1, further comprising a radial choke joint configured to prevent RF power from leaking out of the cavity body.

13. The tunable RF cavity of claim 1, wherein the corresponding change in resonant frequency of the RF cavity is within a tunable frequency range of between 361 MHz and 391 MHz.

14. A method of rapidly tuning an RF cavity, the method comprising:

inserting one or more ferroelectric elements within an interior region of the RF cavity;

applying a DC electric field bias across the one or more ferroelectric elements so as to induce a change in dielectric permittivity of the one or more ferroelectric elements within a time period, and thereby induce a corresponding change in a resonant frequency of the RF cavity;

wherein the act of applying the DC electric field bias across the one or more ferroelectric elements comprises providing one or more copper cylinders supported by supporting rods, and applying a voltage bias between at least one of the one or more of the copper cylinders and one or more side walls of the RF cavity.

15. The method of claim 14, further comprising the act of using the supporting rods to provide fluid cooling to the one or more copper cylinders.

16. The method of claim 14, wherein the one or more ferroelectric elements comprise barium-strontium titanate (BST).

17. The method of claim 14, wherein the time period is less than about ten nanoseconds, and wherein the change in the dielectric permittivity is between about 10% to about 20%.

18. The method of claim 14, wherein the act of inducing the corresponding change in resonant frequency of the RF cavity is performed within a frequency range of about 361 MHz to about 391 MHz.

19. The method of claim 14, further comprising the act of adding a layer of an additional material on a surface of the one or more ferroelectric elements so as to increase strength and thermal conductivity of the one or more ferroelectric elements.

20. The method of claim 19, wherein the additional material comprises CVD (chemical vapor deposition) diamond.

21. The method of claim 14, further comprising the act of providing a radial choke joint so as to prevent RF power from leaking out of the cavity body.

* * * * *